US005544867A

United States Patent [19]

Neyer

[11] Patent Number: 5,544,867

[45] Date of Patent: Aug. 13, 1996

[54] APPARATUS AND PROCESS FOR TRANSPORTING MOLTEN METAL

[76] Inventor: Richard H. Neyer, 12135 Bridgeport La., Cincinnati, Ohio 45240

[21] Appl. No.: 402,892

[22] Filed: Mar. 13, 1995

[51] Int. Cl.[6] ..... C21B 7/12

[52] U.S. Cl. ..... 266/45; 266/165; 266/236; 266/275

[58] Field of Search ..... 266/227, 228, 266/229, 230, 236, 165, 243, 245, 45, 275

[56] References Cited

U.S. PATENT DOCUMENTS

| | | | |
|---|---|---|---|
| 1,853,518 | 4/1932 | Forsythe | 266/230 |
| 2,177,716 | 10/1939 | Heuer | 266/165 |
| 2,360,065 | 10/1944 | Lewis | 266/227 |
| 2,554,836 | 5/1951 | McFeaters | 266/243 |
| 3,589,303 | 6/1971 | Lakin | 105/265 |
| 3,661,374 | 5/1972 | Van Wierst | 266/165 |
| 3,865,282 | 2/1975 | Sieurin | 222/356 |
| 3,897,048 | 7/1975 | Pearce et al. | 266/35 |
| 4,096,976 | 6/1978 | Daussan | 222/591 |
| 4,135,703 | 1/1979 | Nagati et al. | 266/165 |
| 4,195,822 | 4/1980 | Grochowski | 266/165 |
| 4,424,955 | 1/1984 | Wells | 266/44 |
| 4,429,860 | 2/1984 | Fischley et al. | 266/44 |
| 4,524,954 | 6/1985 | Baas et al. | 266/45 |
| 4,555,266 | 11/1985 | Wells | 75/53 |
| 4,657,226 | 4/1987 | Illemann et al. | 266/220 |
| 4,726,568 | 2/1988 | Nicholson | 266/275 |
| 4,848,751 | 7/1989 | Lutgen et al. | 266/44 |

*Primary Examiner*—Scott Kastler

*Attorney, Agent, or Firm*—Dann, Dorfman, Herrell and Skillman; Roger W. Herrell

[57] ABSTRACT

An apparatus and a process are provided for transferring molten metal. The disclosed apparatus includes a vessel having a cylindrical wall, a closed end, and an open end. An opening is provided in the cylindrical wall for pouring molten metal into the vessel. A spout is formed over the open end of the cylindrical wall and provides an orifice from which the molten metal can be discharged from the vessel. The cylindrical wall, the closed end, and the spout define an enclosure for holding the molten metal.

The disclosed process employs a vessel as described above for holding molten metal. The vessel is positioned adjacent to a first processing station containing molten metal from which the molten metal is cast into the vessel. The molten metal is then transported directly to a second processing station in the vessel and discharged from the vessel directly into the second processing station for further processing.

22 Claims, 5 Drawing Sheets

APPARATUS AND PROCESS FOR TRANSPORTING MOLTEN METAL

FIELD OF THE INVENTION

The present invention relates to an apparatus and a process for transporting molten metal. More specifically, the present invention relates to a process in which molten metal is transported in a single transfer vessel from a blast furnace to a basic oxygen furnace. The present invention also relates to a transfer vessel that is constructed to facilitate such process.

BACKGROUND OF THE INVENTION

In the steel making industry, it is common to smelt iron ore in a blast furnace to produce hot, molten pig iron. The molten pig iron is then transferred to other areas of the steel mill, such as a basic oxygen furnace, for further processing into steel. In a steel mill, the molten pig iron is transferred by means of transfer vessels such as torpedo or bottle cars.

A torpedo car typically includes an elongated vessel which is rotatable about its longitudinal axis, as disclosed for example in U.S. Pat. No. 3,661,374. An opening is formed in the central portion of the rotatable vessel. Molten metal is poured into the vessel through the opening when the vessel is oriented with the opening in an upward-facing position. The molten metal is discharged from the vessel through the opening when the vessel is rotated about its longitudinal axis. Rotation of the vessel is typically accomplished by a complicated mechanism which requires frequent maintenance.

In a torpedo car, the vessel is mounted between spaced apart railcar trucks thereby allowing the vessel to be transported along rails or tracks. Since the rails usually do not run directly between the blast furnace and the basic oxygen furnace (hereinafter, b.o.f.), the torpedo car must be switched from one set of rails to another. Such shunting increases the time needed to transport the molten metal to the b.o.f. The tracks and the locomotive used to pull the torpedo cars must be frequently maintained.

Typically, the tap hole of a blast furnace is located on or near the bottom of the furnace and a torpedo car must therefore be designed to fit beneath the furnace. Further, large torpedo cars are difficult to rotate and are less stable due to their high center of gravity. Hence, the maximum size of the torpedo cars is limited and many torpedo cars are generally needed to transfer enough molten metal from the furnace to constitute a single charge for the b.o.f.

The known process of transporting molten metal from a blast furnace to a b.o.f. is illustrated schematically in FIG. 7. A transport vehicle transports a full transfer vessel 78, such as a torpedo car, from a first discharging location 71 of a blast furnace 70 to a holding station 80 along a Path 51. The transport vehicle proceeds along a Path 52, picks up an empty transfer vessel 78' and transports it along a Path 53 to the first discharging location 71. The transport vehicle then proceeds along a Path 54, picks up the full vessel 78 and transports it along a Path 55 to a molten metal pouring station 82, where the contents of the transfer vessel 78 are cast into a receiving vessel 83. The first transport vehicle then transports the empty transfer vessel 78 along Path 56 and positions the empty transfer vessel 78 at a second discharging location 71' of the blast furnace 70.

An overhead crane transfers the full receiving vessel 83 from the pouring station 82 to a receiving station 85 of the b.o.f. 87 along a Path 57. The molten metal is typically desulphurized in the receiving vessel 83 at the receiving station 85. The overhead crane proceeds along a Path 58 to an empty receiving vessel 83' which it picks up and transports along Path 59 to the pouring station 82. A disadvantage of this process, aside from its complexity, is the need to build and maintain a pouring station 82. In addition, the transfer of molten metal to a receiving vessel 83 typically results in a 56° C. (100° F.) loss of heat. This heat must later be restored to the molten metal which adds to the production cost. Further, the transfer of molten metal to the receiving vessel 83 results in the release of polluting gases and iron dust into the environment.

Accordingly, it would be highly advantageous to provide an apparatus and a process whereby sufficient molten metal for further processing is transferred from a furnace directly to a single, large capacity vessel. This eliminates the need for transferring the molten metal to a receiving vessel which, in turn, reduces environmental pollution, increases the molten metal charge temperature, and eliminates the cost of building and maintaining a molten metal pouring station. Preferably, the vessel should be simple to construct and easy to operate and maintain. Further, the apparatus should be suitable for use with existing blast furnaces without requiring major structural changes to the furnace. Additionally, the apparatus should be easily adapted for transport by rubber tire or pallet carriers in order to decrease the transport time and eliminate the need for locomotives and tracks to transport the vessel.

SUMMARY OF THE INVENTION

The problems associated with the known transfer vessels and their use, are solved to a large degree by an apparatus and a process in accordance with the present invention. A quantity of molten metal for further processing is transferred directly to a single; large capacity transfer vessel. The transfer vessel according to the present invention has sufficient capacity to hold a full charge of molten metal. This eliminates the need for first discharging the molten metal to a series of transport vessels and then later transferring the molten metal to a large capacity receiving vessel. Elimination of this transfer step results in a reduction in environmental pollution, a reduction in the heat lost by the molten metal charge, and eliminates the need for a molten metal pouring station.

The apparatus in accordance with the present invention is embodied as a vessel having a first portion having a cylindrical wall, a closed end, and an open end. An opening is provided in the cylindrical wall for pouring molten metal therethrough into the vessel. A spout is formed over the open end of the first portion. The spout provides an orifice from which the molten metal can be discharged from the vessel. The cylindrical wall, the closed end, and the spout define an enclosure for holding the molten metal. The vessel is also provided with trunnions attached to the exterior of the cylindrical wall for lifting and tilting the vessel.

In another embodiment, the apparatus according to this invention comprises a stand for supporting the vessel. The support stand is constructed and arranged to facilitate lifting and transporting of the vessel by a truck, such as a pallet carrier truck or a c-frame carrier truck. The support stand is generally constructed as a free-standing support having a frame to support the vessel, a base to support the frame above the ground, and a stabilizing means to stabilize the vessel when it is supported by the support stand.

In accordance with another aspect of the present invention, there is provided a process in which a vessel is provided for holding molten metal. The vessel is positioned adjacent to a first processing station containing the molten metal. The molten metal is cast from the first processing station into the vessel. The vessel is then transported directly to a second processing station. The molten metal is then discharged from the same vessel into the second processing station for further processing.

BRIEF DESCRIPTION OF THE DRAWINGS

The foregoing summary, as well as the following detailed description of a preferred embodiment of the present invention, will be better understood when read in conjunction with the accompanying drawings, of which.

DETAILED DESCRIPTION OF THE PREFERRED EMBODIMENTS

Figure 1:
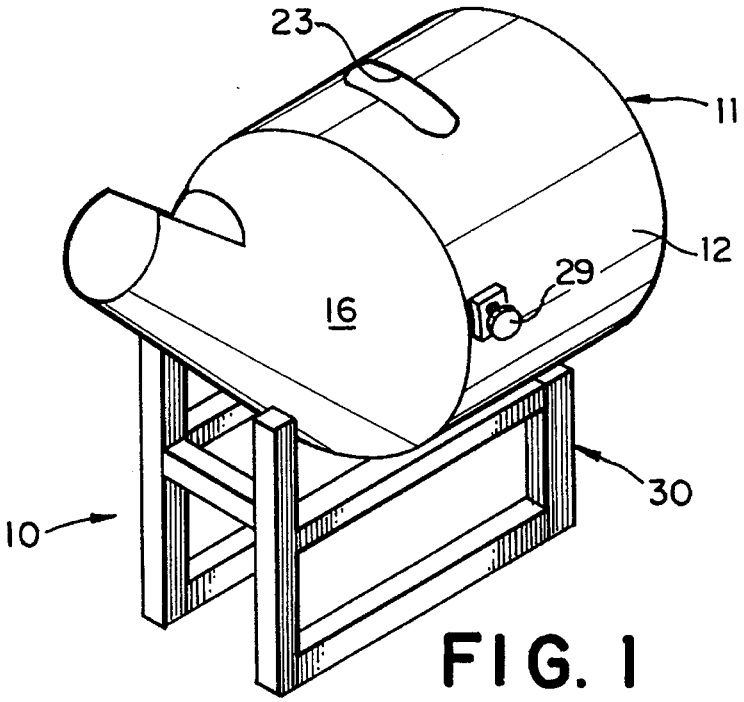
FIG. 1 is a top, front perspective view showing an apparatus for transporting molten metal in accordance with the present invention.

Referring now to the drawings, and in particular to FIG. 1, there is shown an apparatus 10 for transporting molten metal in accordance with the present invention. Apparatus 10 comprises a vessel 11 which is designed to hold the molten metal. Preferably, the apparatus 10 also comprises a support stand 30, designed to support and to facilitate transport of the vessel 11.

Figure 2:
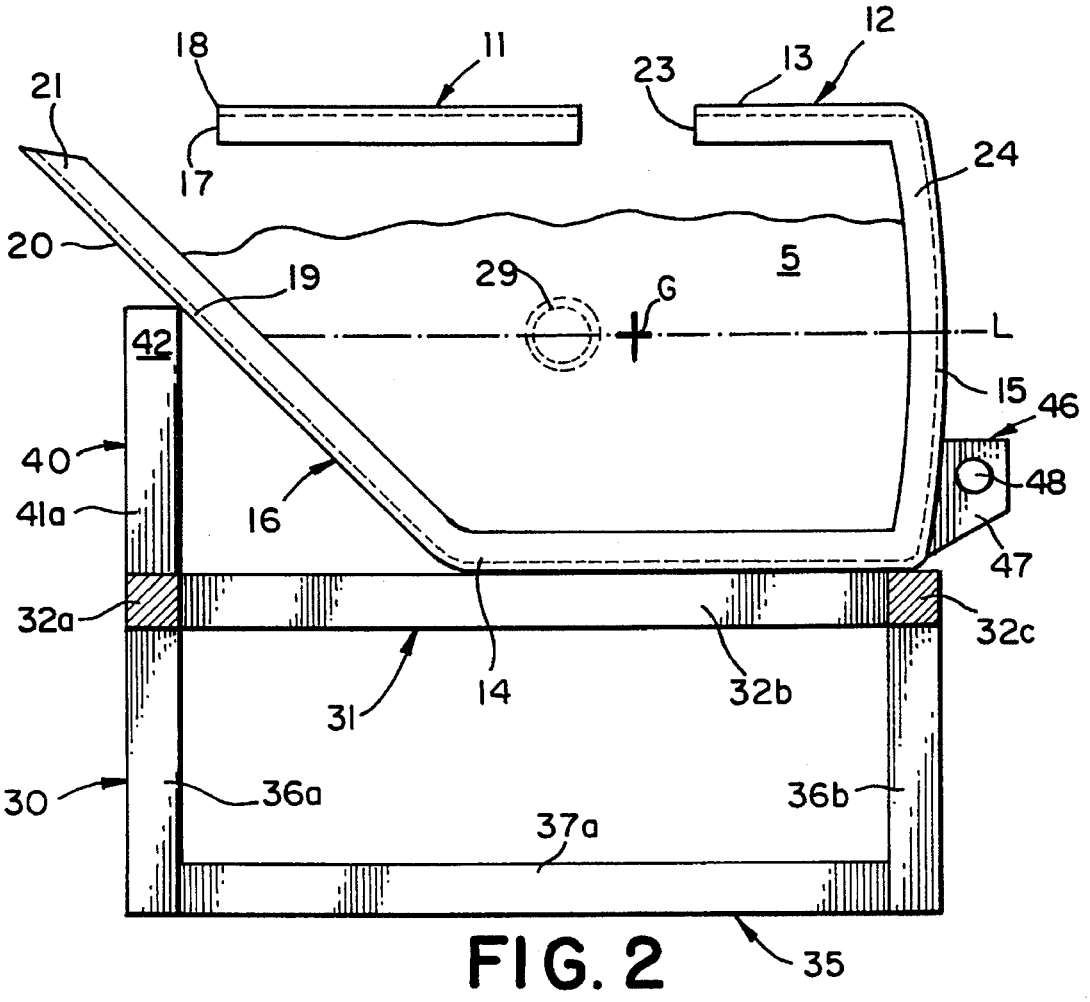
FIG. 2 is a side elevation view, in section, of the apparatus depicted in FIG. 1.
Figure 3:
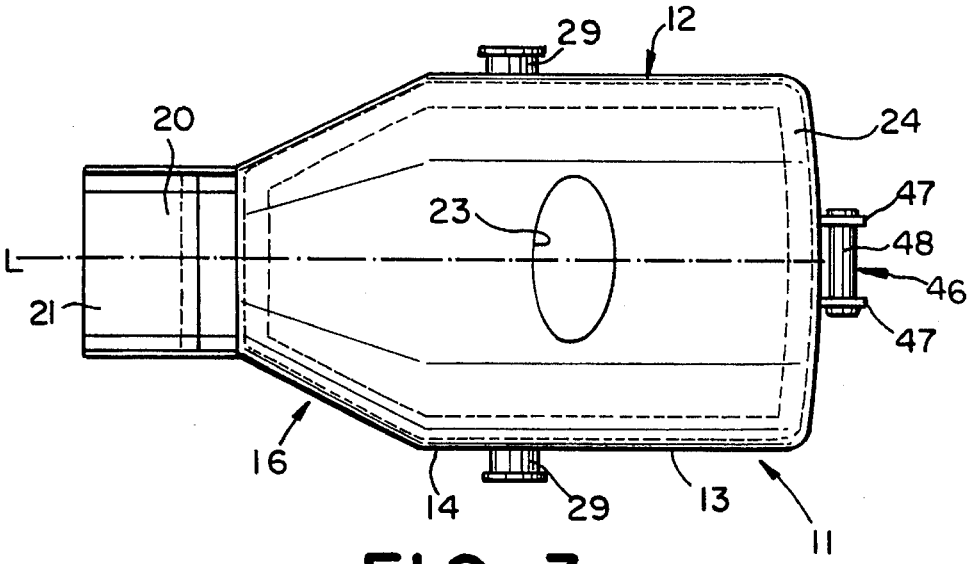
FIG. 3 is a top plan view of the apparatus depicted in FIG. 1.
Figure 4:
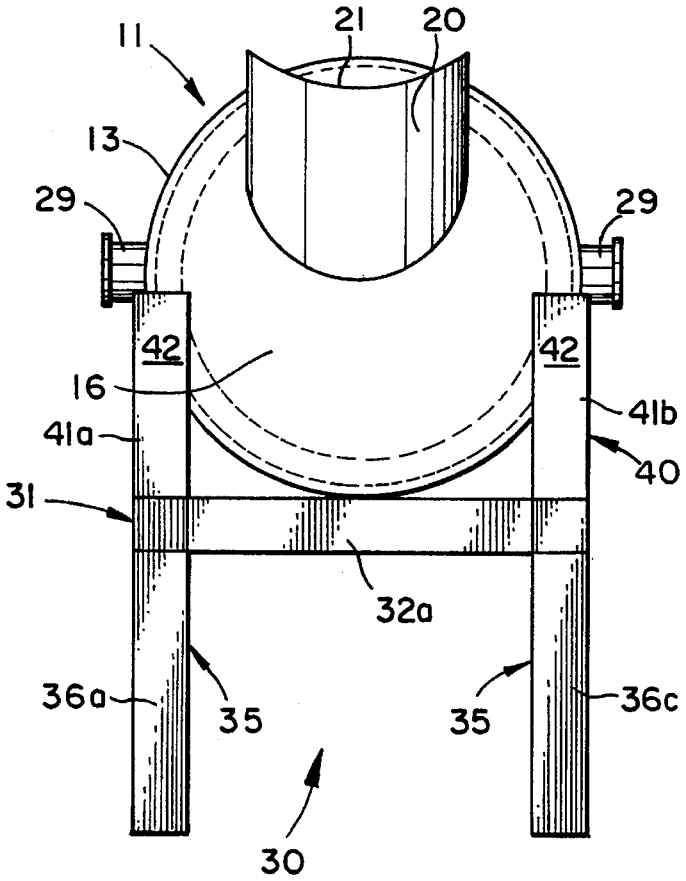
FIG. 4 is a front elevation view of the apparatus depicted in FIG. 1.

The vessel 11, as best Shown in FIGS. 2–4, comprises a first portion 12 having a generally cylindrical wall 13, a closed end 15, and an open end 14. The cylindrical shape provides an even distribution of the weight of the molten metal 5 thereby increasing the carrying capacity of the vessel 11. As shown in the figures, the vessel 11 has a longitudinal axis L that is preferably oriented horizontally when the vessel 11 is transporting molten metal 5. An opening 23 is provided in the top of the cylindrical wall 13. The opening 23 is generally upwardly facing so that molten metal 5 can be poured therethrough into the vessel 11. A spout 16 is formed over the open end 14 of the first portion 12 for discharging the molten metal 5 out of the vessel 11. The spout 16 has an orifice 17, defined by an upper lip 18 and a lower lip 19 of the spout 16. The spout 16, the closed end 15, and the cylindrical wall 13 define an enclosure for holding the molten metal 5 during transport.

In the embodiment shown in FIGS. 2–4, the spout 16 is formed as an extension of the cylindrical wall 13. The bottom portion of spout 16 angles upwardly and tapers down such that the orifice 17, defined by the upper lip 18 and lower lip 19 of the spout 16, is substantially smaller in diameter than the open end 14 of the first portion 12. The slope of the angled bottom portion of spout 16 is chosen by considering that the shallower the slope the longer the overall length of the vessel 11 and the steeper the slope the more the vessel 11 will need to be tilted in order to pour the molten metal 5. A semi-circular trough 20 extends from the spout 16 at the lower lip 19 of the orifice 17. The trough 20 facilitates pouring of molten metal 5 from the vessel 11. This arrangement of spout 16 provides a smooth, angled path along which the molten metal 5 can be poured. It will also be appreciated, that this arrangement provides for a spout 16 with a generally circular cross-section that is perpendicular to the longitudinal axis L of the vessel 11, thereby more evenly distributing the weight of the molten metal and increasing the pouring capacity of the spout 16. As shown in the figures, the discharge end 21 of the trough 20 is preferably near the top of the first portion 12, in order to maximize the holding capacity of the vessel 11.

The size and shape of opening 23 are selected to facilitate the tapping or pouring of molten metal 5 into the vessel 11. Preferably, the opening 23 is generally circular or oval, as shown in FIG. 3. In order to minimize the amount of heat lost from the molten metal 5 through the opening 23 prior to and during transport, an insulated lid (not shown) is provided for closing the opening 23 once the molten metal 5 has been tapped or poured into the vessel 11. A suitable lid is disclosed and shown in U.S. Pat. No. 4,524,954 which is incorporated herein by reference.

The cylindrical wall 13, closed end 15, and spout 16 are preferably made from about 7 cm (2.8 inch ) thick steel. Preferably, the interior surfaces of the cylindrical wall 13, closed end 15, and spout 16 are lined with an insulating material lining 24 to protect the vessel 11 from the extreme temperatures of the molten metal (in excess of 1480° C. (2700° F.)), to retain heat, and to limit erosion of the metal walls. For example, the vessel 11 can be lined with a 23 cm (9 inch) thick layer of a standard, commercially available, high alumina lining. Since the region of the vessel 11 opposite the opening 23 is most prone to thermal stress and erosion, the lining 24 in that area is preferably thicker than the rest of the lining 24.

Figure 5:
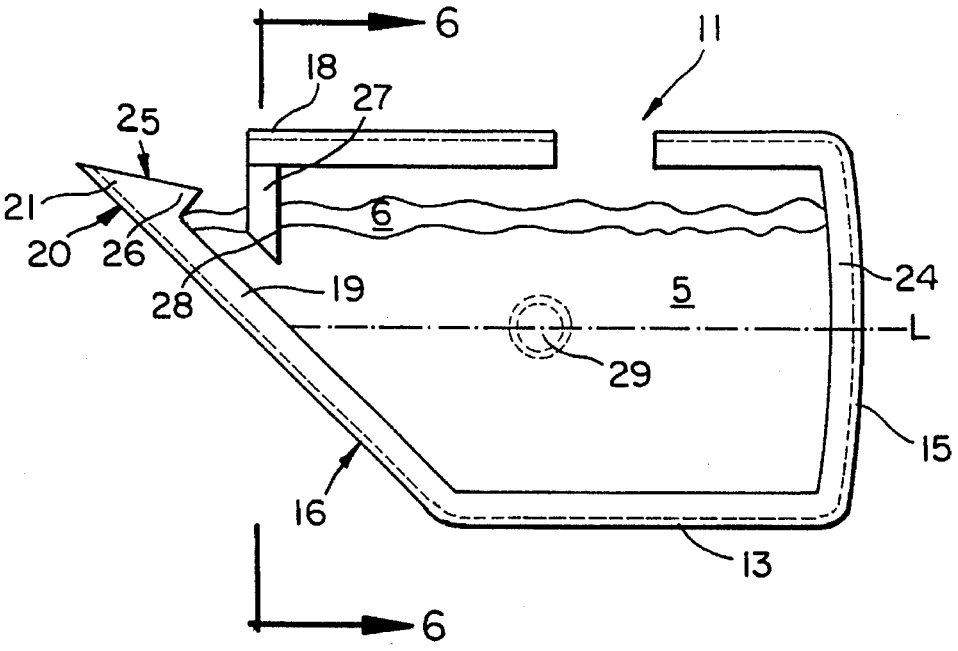
FIG. 5 is a side elevation view, in section, of an apparatus for transporting molten metal having a slag skimmer in accordance with the present invention.
Figure 6:
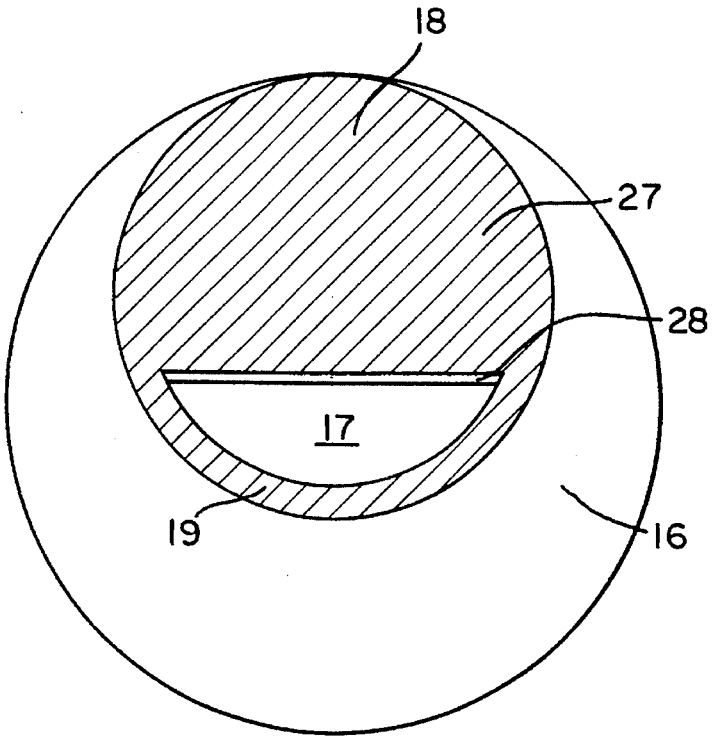
FIG. 6 is a partial sectional view of the spout of the apparatus depicted in FIG. 5 as viewed along line 6—6.
Figure 7:
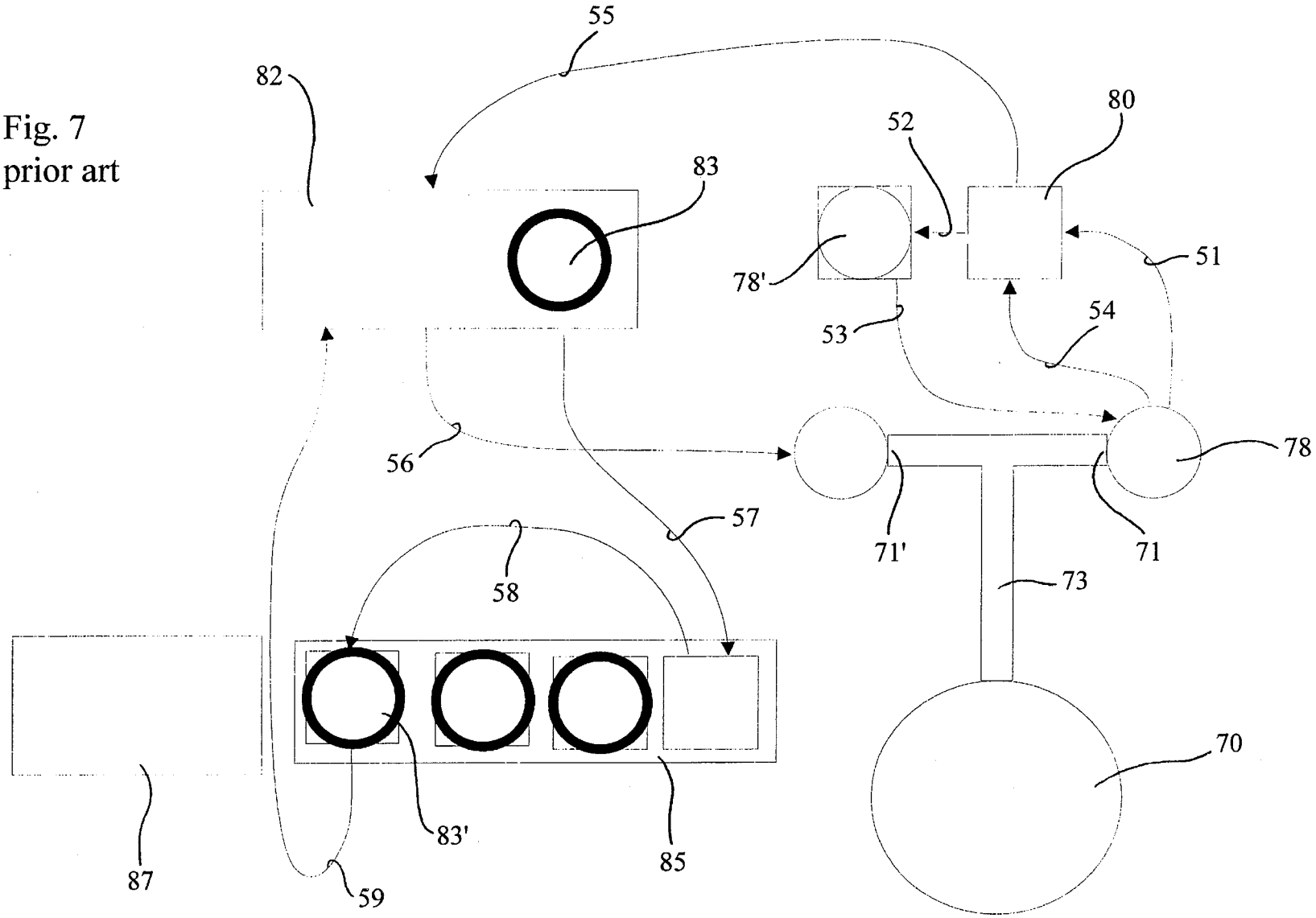
Fig. 7 prior art
FIG. 7 is a schematic representation of a prior art process for transporting molten metal.

In a further embodiment of the apparatus according to the present invention, vessel 11 includes a skimmer for skimming slag 6 off the top of the molten metal 5 as the metal 5 is poured from the vessel 11. As shown in FIGS. 5 and 6, the skimmer comprises a dam 25 and a partition 27. The partition 27 extends from the upper lip 18 of the spout 16 and projects into the vessel 11, so that the free end 28 of partition 27 is below the level of the slag 6 which floats on top of the molten metal 5. Preferably, the free end 28 of the partition 27 is cut or machined at an angle parallel to the slope of the spout 16. The partition 27 is preferably manufactured from the same material as the cylindrical wall 13. The dam 25 comprises a raised ridge 26 on the discharge end 21 of the trough 20. The dam 25 helps to maintain the upper level of the molten metal 5 above the free end 28 of the partition 27 as the molten metal is poured out of the vessel. Preferably, the height of the ridge 26 is about the same as the distance from the free end 28 of the partition 27 to the spout 16.

To facilitate pouring of the molten metal 5 from the vessel 11, trunnions 29 are attached to the exterior of vessel 11 on the cylindrical wall 13. As shown in FIG. 3, the trunnions 29 are perpendicular to the longitudinal axis L of the vessel 11 and equally spaced on either side of the opening 23, so that an axis passing through the centers of the trunnions 29 lies in a horizontal plane, the horizontal plane intersecting with the center of gravity G of the vessel 11 when filled with molten metal 5. The axis running through the center of the trunnions 29 is located between the spout 16 and the center of gravity G of the vessel 11 when filled with molten metal 5. Such an arrangement inhibits accidental tipping of the vessel 11. A tilting lug 46 is attached to the closed end 15 of the first portion 12 of vessel 11. Preferably, the tilting lug 46 comprises two plates 47 in spaced parallel relation which are welded to the bottom, center of the closed end 15. A pin 48 extends between and through the plates 47 and is generally perpendicular thereto. An overhead crane can be used to lift the vessel 11 by the trunnions 29. When thus supported, the vessel 11 can be tilted by using a holding block of the crane to pull upwardly on the tilting lug 46, thereby discharging the molten metal 5 into a steel making furnace, for example.

The dimensions of the vessel 11 are chosen based on the manner in which the vessel 11 will be used. For example, if the vessel 11 is to be used for transporting molten metal from a blast furnace to a b.o.f., the vessel 11 must be designed to fit within the space adjacent to the discharging location of the blast furnace, preferably without major structural modification of the blast furnace. Additionally, vessel 11 is designed to carry a quantity of molten metal approximately equal to, or greater than, the charge size of the b.o.f., or other metal processing device. In order to match the dimensions of the vessel 11 to the needs of specific applications, the length and the diameter of the cylindrical first portion 12 of the vessel 11 can be varied in accordance with known methods.

Referring again to FIG. 1, the apparatus 10 includes a support stand 30. The support stand 30 is generally constructed from structural steel to be a free-standing support for the vessel 11. The support stand 30 is also constructed to facilitate transporting the vessel 11 by providing an arrangement by which a pallet carrier or rubber tire carrier can carry the vessel 11. The precise shape and dimensions of the support stand 30 depends upon the size of the vessel 11. Since the molten metal 5 is generally discharged through a tap hole at the bottom of the furnace, the vessel 11 together with the support stand 30 must be dimensioned so that both the vessel 11 and the stand 30 fit beneath the furnace without major structural modification to the furnace.

The support stand 30 generally comprises a frame 31 to support the vessel 11, a base 35, and a stabilizer 40. The base 35 supports the frame 31 above the ground. The stabilizer 40 extends from frame 31 to prevent the vessel 11 from rotating or shifting when the vessel 11 is supported on stand 30. The stabilizer 40 preferably comprises a yoke or struts which support the spout 16 of the vessel 11. A second stabilizer (not shown) can be used to support the cylindrical wall 13 for better stability.

In a preferred embodiment as shown in FIGS. 1,2, and 4, the frame 31 of the support stand 30 is constructed of four beams 32*a–d* arranged in a rectangular fashion. The length of the rectangle is longer than the length of the first portion 12 of the vessel 11 but shorter than the overall length of the vessel 11. Thus, the vessel 11 can be positioned with the bottom portion of the cylindrical wall 13 resting lengthwise on the frame 31. The base 35 comprises struts 36*a–d* each extending downwardly from one of the four corners of the frame 31. A first beam 37*a* interconnects the struts 36*a* and 36*b* on one side of the stand 30 to each other. A second beam 37*b* (not shown) interconnects the other two struts 36*c* and 36*d* of stand 30. The base 35 supports the frame 31 above the ground, so that the lift mechanism of a pallet carrier can be easily positioned under frame 31. The stabilizer 40 comprises two struts 41*a* and 41*b* extending upwardly from the front of the frame 31. Struts 41*a* and 41*b* are positioned so that the free ends 42*a* and 42*b* thereof bear against spout 16. The lengths of the struts 41 are chosen so that the longitudinal axis L of the vessel 11 is parallel to the frame 31 when the vessel 11 is supported by the support stand 30.

Figure 8:
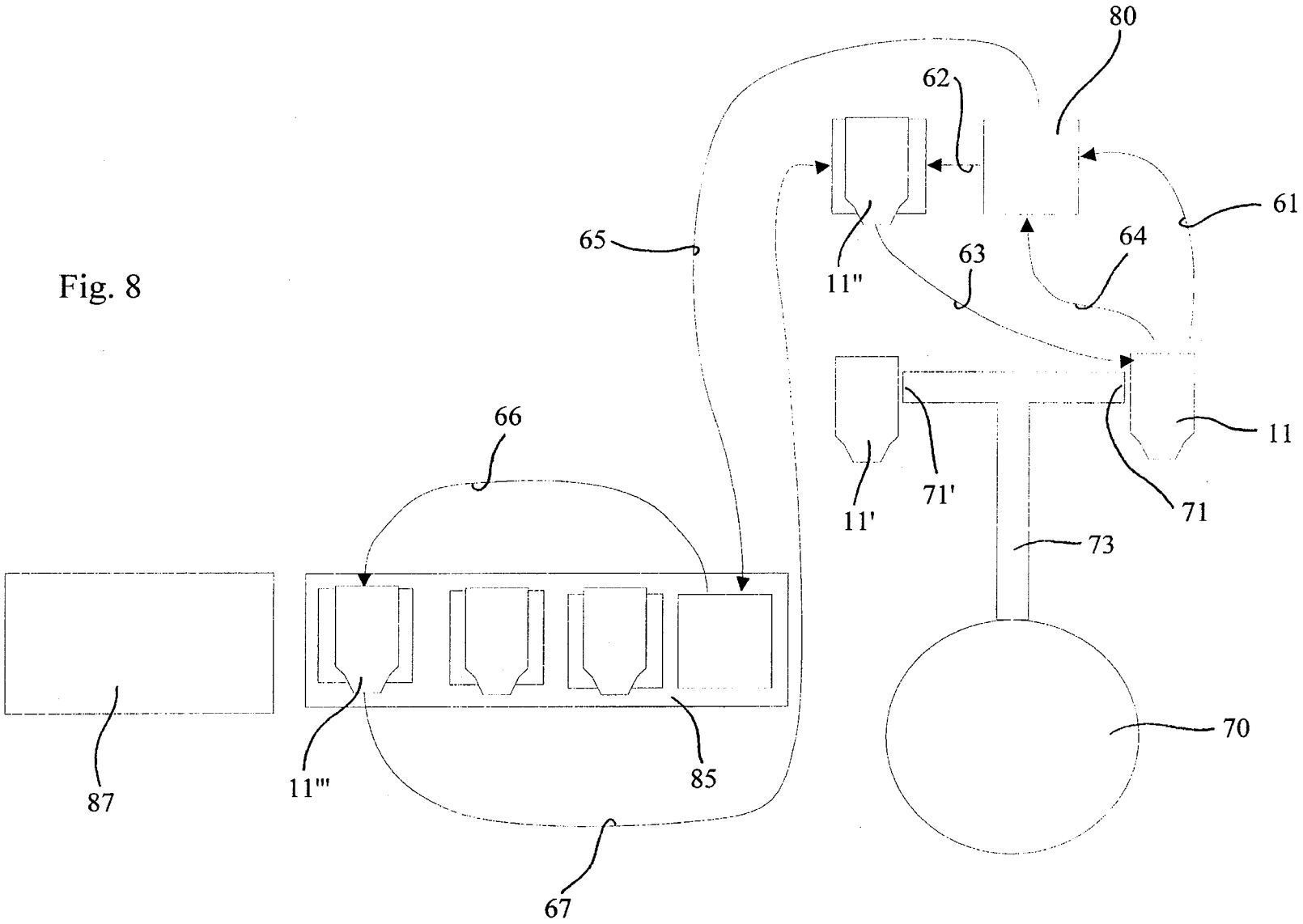
FIG. 8 is a schematic representation of a process for transporting molten metal in accordance with the present invention.

The process according to the present invention is illustrated schematically in FIG. 8. An apparatus 10 or vessel 11, as described hereinabove, is positioned at a charging location 71 of a first processing station 70 containing molten metal, such as a blast furnace. The molten metal 5 is allowed to flow from the first processing station 70 into the vessel 11 until it is substantially filled with molten metal 5. The vessel 11 is then transported to a receiving station 85 of a second processing station 87, such as a b.o.f. The molten metal 5 is discharged from the vessel 11 to the second processing station 87 without the need for first transferring the molten metal 5 to a second receiving vessel as is done in the known practice.

Preferably, the vessel 11 is positioned at the charging location 71 of the first processing station 70 and/or transported to the second processing station 87 using a truck, such as a pallet carrier truck (Kress Model EP-660C) or a c-frame carrier truck (Kress Model LE-600C). In an embodiment where the apparatus 10 includes a support stand 30 such as the one shown in FIGS. 1, 2, and 4, the stand 30 acts as a pallet which can be lifted by the pallet carrier truck to facilitate transport of the vessel 11 to the second processing station 87 where further processing is to take place. The vessel 11 is first positioned on the support stand 30 by, for example, an overhead crane. The pallet carrier truck is then positioned with the lifting mechanism of the truck under the frame 31 of the support stand 30. When operated, the lifting mechanism exerts an upward force on the frame 31 thereby lifting the support stand 30 and the vessel 11. The use of a pallet carrier truck or a c-frame carrier truck eliminates the need for rails or tracks running between the first processing station 70 and the second processing station 87 and shortens the transportation time.

More specifically, in the process according to the present invention, molten metal 5 is discharged through a tap hole of the blast furnace 70 to a first discharging location 71 using, for example, a runner 73. The molten metal 5 flows into a first vessel 11 which has been positioned at the first discharging location 71 of the furnace 70. When the first vessel 11 is substantially full, the flow of molten metal is diverted to a second vessel 11' located at the second discharging location 71'. The full first vessel 11 is transported by a transport vehicle along Path 61 from the charging location 71 of the blast furnace 70 to a holding station 80. The transport vehicle proceeds along Path 62, picks up an empty third vessel 11", and transports it along Path 63 to the first charging location 71. The transport vehicle then proceeds along Path 64 to holding station 80, picks up the first vessel 11, and transports it along Path 65 directly to the receiving station 85 of the b.o.f. 87, without transferring the molten metal 5 to a separate receiving vessel 83. The transport vehicle then proceeds along Path 66, picks up an empty fourth vessel 11'", and transports it along Path 67 to the holding station 80 so that it can be used to replace the second vessel 11' once the second vessel 11' has been filled. This process is repeated until the entire charge from the blast furnace 70 has been transported to the b.o.f. 87.

In the preferred embodiment, two transport vehicles are used. The full first vessel 11 is transported by the first transport vehicle along Path 61 from the charging location 71 of the blast furnace 70 to a holding station 80. The first transport vehicle proceeds along Path 62, picks up an empty vessel 11", and transports it along Path 63 to the first charging location 71. The first transport vehicle is then ready to repeat the process for a second vessel 11'. The second transport vehicle picks up the first vessel 11 at the holding station 80 and transports it along Path 65 directly to the receiving station 85 of the b.o.f. 87, without transferring the molten metal 5 to a separate receiving vessel 83. The second transport vehicle then proceeds along Path 66, picks up an empty fourth vessel 11''', and transports it along Path 67 to the holding station 80 so that it can be used to replace the second vessel 11' once the second vessel 11' has been filled.

A desulphurization step can be performed on the molten metal 5 between the blast furnace 70 and the b.o.f. 87. When desulphurization is necessary, it can be performed directly in the vessel 11 by, for example, inserting an oxygen lance into the molten metal 5 through the opening 23 of the vessel 11. A lance suitable for this purpose is described in U.S. Pat. No. 4,848,751 which is incorporated herein by reference. Preferably, desulphurization is performed at the receiving station 85 of the b.o.f. 87. In this respect, the process and apparatus according to the present invention obviate the need for a separate pouring station.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A vessel for holding molten metal during the transporting thereof, said vessel comprising:

a. a first portion having a generally cylindrical wall, a closed end, and an open end, said first portion having an opening formed in the cylindrical wall for receiving molten metal therethrough and said open end having an opening formed therein that is commensurate with the inside diameter of the cylindrical wall;

b. a spout formed over the open end of said first portion, said spout having:

(i) an inlet that is commensurate with the opening formed in the open end of said first portion;

(ii) a bottom portion that angles upwardly to provide a smooth path along which the molten metal can be discharged; and (iii) an orifice through which the molten metal can be discharged from the vessel, said orifice being disposed so as to be above a load of molten metal in the vessel when the vessel is in an untilted position; and c. means for tilting said vessel to discharge the molten metal therefrom.

2. The vessel in accordance with claim 1 further comprising a skimmer disposed in said vessel for skimming slag off the top of the molten metal when the molten metal is poured from the vessel.

3. The vessel in accordance with claim 2 wherein the skimmer comprises a partition extending into the vessel.

4. The vessel in accordance with claim 3 wherein the partition extends into the vessel from the upper lip of the orifice.

5. The vessel in accordance with claim 3 further comprising a dam formed on the lower lip of said spout.

6. The vessel in accordance with claim 1 further comprising a trough extending from the lower lip of the orifice, the trough having a discharge end.

7. The vessel in accordance with claim 6 further comprising a skimmer disposed in said vessel for skimming slag off the top of the molten metal when the molten metal is poured from the vessel.

8. The vessel in accordance with claim 7 wherein the skimmer comprises a partition extending into the vessel.

9. The vessel in accordance with claim 8 wherein the partition extends into the vessel from the upper lip of the spout.

10. The vessel in accordance with claim 9 further comprising a dam formed on the discharge end of the trough.

11. The vessel in accordance with claim 1 wherein the tilting means comprises a trunnion for lifting and tilting the vessel.

12. The vessel in accordance with claim 11 wherein the tilting means comprises a tilting lug.

13. The vessel in accordance with claim 1 wherein the transfer vessel has a longitudinal axis that is oriented horizontally when the transfer vessel transports the molten metal.

14. An apparatus for transporting molten metal comprising:

a vessel for holding the molten metal during the transporting thereof, said vessel comprising a. a first portion having a generally cylindrical wall, a closed end, and an open end, said first portion having an opening formed in the cylindrical wall for receiving molten metal therethrough and said open end having an opening formed therein that is commensurate with the inside diameter of the cylindrical wall;

b. a spout formed over the open end of said first portion, said spout having:

(i) an inlet that is commensurate with the opening formed in the open end of said first portion;

(ii) a bottom portion that angles upwardly to provide a smooth path along which the molten metal can be discharged; and (iii) an orifice through which the molten metal can be discharged from the vessel, said orifice being disposed so as to be above a load of molten metal in the vessel when the vessel is in an untilted position; and c. means for tilting said vessel to discharge the molten metal therefrom; and a stand for supporting said vessel, said stand being constructed and arranged for being lifted and supported by a wheeled vehicle, whereby said apparatus can be moved between first and second processing stations.

15. The apparatus in accordance with claim 14 wherein the stand comprises:

a. a frame to support the vessel;

b. a base to support the frame above the ground; and c. a stabilizer to stabilize the vessel when the vessel is supported by the stand.

16. A process for transferring molten metal from a bottom-tapped processing station to a top-loading processing station consisting essentially of the steps of:

a. providing a transfer vessel that is formed for holding molten metal;

b. positioning the transfer vessel adjacent to a bottom-tapped processing station containing molten metal;

c. casting the molten metal from the bottom-tapped processing station into the transfer vessel through an opening in the top of said transfer vessel;

d. transporting the transfer vessel to a top-loading processing station; and then e. discharging the molten metal through a second opening in the top of the transfer vessel into the top-loading processing station for further processing.

17. The process in accordance with claim 16 further comprising the step of providing a support stand for supporting the transfer vessel and wherein the step of discharging the molten metal into the top-loading processing station includes the steps of lifting the transfer vessel off of the support stand, positioning the transfer vessel over the top-loading processing station, and then tilting the transfer vessel to cause the molten metal to pour out of the second opening in the top of the transfer vessel.

18. The process in accordance with claim 16 wherein the transporting step comprises the step of transporting the molten metal in the transfer vessel using a pallet carrier truck.

19. The process in accordance with claim 16 further comprising the step of desulphurizing the molten metal after the molten metal has been cast into the transfer vessel and before the molten metal is discharged into the top-loading processing station.

20. The process in accordance with claim 19 wherein the step of desulphurizing the molten metal is performed in the transfer vessel.

21. The process in accordance with claim 16 wherein the step of providing the transfer vessel comprises the step of providing a vessel comprising:

a. a first portion having a generally cylindrical wall, a closed end, and an open end, said first portion having an opening formed in the cylindrical wall for receiving molten metal therethrough and said open end having an opening formed therein that is commensurate with the inside diameter of the cylindrical wall;

b. a spout formed over the open end of said first portion, said spout having:

(i) an inlet that is commensurate with the opening formed in the open end of said first portion;

(ii) a bottom portion that angles upwardly to provide a smooth path along which the molten metal can be discharged; and (iii) an orifice through which the molten metal can be discharged from the vessel, said orifice being disposed so as to be above a load of molten metal in the vessel when the vessel is in an untilted position and c. means for tilting said vessel to discharge the molten metal therefrom.

22. The process in accordance with claim 17 wherein during the step of tilting the transfer vessel, the transfer vessel is tilted to an angle less than 90 degrees from its starting position but sufficient to discharge the load of molten metal.

* * * * *